US006966675B2

(12) United States Patent
Albou

(10) Patent No.: US 6,966,675 B2
(45) Date of Patent: Nov. 22, 2005

(54) LIGHTING MODULE FOR A VEHICLE HEADLIGHT

(75) Inventor: Pierre Albou, Boginy (FR)

(73) Assignee: Valeo Vision, Bobigny Cedex (FR)

( * ) Notice: Subject to any disclaimer, the term of this patent is extended or adjusted under 35 U.S.C. 154(b) by 42 days.

(21) Appl. No.: 10/738,111

(22) Filed: Dec. 16, 2003

(65) Prior Publication Data

US 2004/0130907 A1 Jul. 8, 2004

(30) Foreign Application Priority Data

Dec. 20, 2002 (FR) ..... 02 16430

(51) Int. Cl.[7] ..... F21V 7/00; F21V 14/04

(52) U.S. Cl. ..... 362/298; 362/516; 362/517; 362/518; 362/296; 362/297; 362/341; 362/346

(58) Field of Search ..... 362/516–518, 362/296–298, 341, 346

(56) References Cited

U.S. PATENT DOCUMENTS 1,981,328 A * 11/1934 Rivier ..... 362/298
4,914,747 A 4/1990 Nino
2001/0019486 A1 9/2001 Thominet

FOREIGN PATENT DOCUMENTS

DE 100 09 782 A1 9/2001
EP 1 160 503 A2 5/2001
EP 1 126 210 A2 8/2001
EP 1 128 124 A2 8/2001
EP 1 471 305 * 4/2004 ..... F21V 14/04

OTHER PUBLICATIONS

French Search Report, Jul. 2003.

* cited by examiner

*Primary Examiner*—Thomas M. Sember
*Assistant Examiner*—James W Cranson, Jr.
(74) *Attorney, Agent, or Firm*—Morgan & Finnegan, LLP

(57) ABSTRACT

The present invention is concerned with a lighting module for a vehicle headlight for giving a light beam of the cut-off type, particularly one which is adapted to use with light-emitting diodes. The module has a second reflector having a substantially elliptical surface for reflecting light rays and at least one light source arranged close to the first focus of the first reflector. The module also includes a second reflector for producing the cut-off or dipped output beam, the focus of this reflector being arranged close to the second focus of the first reflector. The module further includes a third reflector or bender, having a reflective top face and being situated between the first and second reflectors. This third reflector has a cut-off edge arranged close to the second focus of the first reflector, whereby to form the cut-off within the light beam. The light source is a light-emitting diode.

13 Claims, 4 Drawing Sheets

LIGHTING MODULE FOR A VEHICLE HEADLIGHT

FIELD OF THE INVENTION

The present invention relates to a lighting module for a vehicle headlight, for producing a light beam of the cut-off type for passing purposes, particularly but not exclusively adapted for use with light-emitting diodes.

A cut-off light beam, also referred to as a passing beam, is to be understood to mean a light beam which has a directional limit, or cut-off, above which any light emitted is of low intensity.

BACKGROUND OF THE INVENTION

The functions of passing or dipped beam lights and foglights are examples of cut-off light beams conforming to current European legislation.

Generally, the cut-off in an elliptical headlight is produced using a mask which is in the form of a vertical plate the profile of which is suitably adapted and which is interposed axially between the elliptical reflector and the convergent lens, and which is arranged close to the second focus of the reflector.

The mask provides an occulting function for the light rays issued from the light source and reflected by the reflector to the lower part of the focal plane of the convergent lens. These rays would, in the absence of any mask, be emitted by the headlight above the cut-off line.

Such a solution does however have certain difficulties.

Thus, one disadvantage of this type of headlight is that a significant part of the light flux emitted by the light source is dissipated in the rear face of the mask.

Another solution consists in making a lighting module which employs a light source and a Fresnel lens or a reflector of the complex surface type. In order to create a cut-off line, it is necessary to align the edges of the images of the light source on the measuring screen which is used in carrying out adjustments to give a regulation light beam.

But again, this solution gives rise to some problems. In this connection, where the light source is a diode, it is very difficult to produce a full cut-off. This is because the image of the virtual source corresponding to the diode is generally round and is diffuse, and it is much more complicated to produce a clean cut-off line by aligning corresponding images of round forms.

This difficulty may be overcome by using a diaphragm with the diode, but a large quantity of the luminous energy produced by the diode is then lost.

In addition, the emission indicators of the known diodes having the best performance are complex, and it is very difficult to obtain a homogeneous beam from direct images of the diode.

DISCUSSION OF THE INVENTION

The present invention aims to provide a lighting module for a vehicle headlight which produces a light beam of the cut-off type that gives a clean cut-off, especially when using a diode as the light source, while giving a homogeneous light beam and offering a reduction in the loss of light flux by avoiding the use of a mask.

According to the invention in a first aspect, there is provided a lighting module for a vehicle headlight for producing a light beam of the cut-off type, the module including:

a first reflector having a substantially elliptical surface for reflecting light rays, and at least one light source arranged in the vicinity of the first focus of the said first reflector, characterized in that the said module further includes:

a second reflector for producing the cut-off output beam, the focus of the said second reflector being located in the vicinity of the second focus of the said first reflector, and a third reflector which is a so-called bender, the upper face of which is reflective, the said bender being located between the said first reflector and the said second reflector and having an edge which is a so-called cut-off edge, and which is arranged in the vicinity of the second focus of the said first reflector, whereby to form the cut-off in the light beam, and in that the light source is a light emitting diode.

Thanks to the invention, the greater part of the light flux emitted from the light source is used in the light beam produced by the module.

In addition, the lighting module according to the invention gives a clean cut-off line, especially when a diode is used as light source, because it projects the image of the cut-off edge forward. The form of the cut-off in the light beam is therefore determined by the profile of the cut-off edge.

In addition, the module according to the invention exploits one property of elliptical lighting modules which is to "mix" images of the light source at the second focus of the first reflector, and this improves the homogeneity of the light beam which is produced.

Finally, such a module has improved optical performance as compared with a system that makes use of a lens. In this connection, there is less loss of energy due to the non-unitary coefficient of reflection of the reflective surface of the second reflector, than by virtue of vitreous reflections within the lens.

In a first embodiment of the invention, the said second reflector has a substantially parabolic surface for reflecting light rays.

In a second embodiment of the invention, the said second reflector is a reflector of the complex surface type for reflecting light rays.

Preferably, the optical axis of the said first reflector defines an angle with the optical axis of the said second reflector, whereby the said first reflector does not intersect light rays reflected by the said second reflector.

This angle is chosen and optimised by making use of the property of diodes that they emit only into a half space, whereby the first reflector does not interrupt a part of the light flux reflected by the second reflector.

In a preferred embodiment of the invention, the said cut-off edge has a profile which is substantially identical to the focal line of the said second reflector in a plane which contains the optical axis of the said second reflector and which is at right angles to the plane defined by the optical axis of the said first reflector and the optical axis of the said light source.

Such a profile enables the cut-off line to be improved by compensating for aberrations in the second reflector, especially in the case of a parabolic surface, with increasing distance from the optical axis of the second reflector.

In a further embodiment, the said cut-off edge is straight. In this case, the cut-off can be improved by making use of a second reflector of a complex surface type.

Preferably, the substantially elliptical surface of the said first reflector is defined by an angular sector of a body which is substantially a body of revolution about the optical axis of the said first reflector, and in that the said angular sector extends vertically above the reflective face of the said third reflector.

Preferably again, the module according to the invention may include a plurality of light sources close to each other, which are generally aligned in a direction substantially at right angles to the optical axis of the said first reflector.

The module of the invention preferably includes means for displacing the said third reflector along the optical axis of the said second reflector.

It is thus possible to obtain a module which gives a light beam of the cut-off type, for example for passing headlights, and at the same time a light beam without any cut-off, for example for cruising headlight purposes.

According to the invention in a second aspect, a method of making a module according to the invention is characterized in that the said first, second and third reflectors are made in one piece.

The low thickness of the module enables all the reflectors to be injection moulded at once in a mould without a pull-out piece with a thin member.

According to a preferred feature of the invention, the said piece is obtained by moulding in a material chosen from the group consisting of a thermoplastic material, a thermosetting material, and an injected metal.

Thus, the material used may be a standard thermoplastic material of the PPS (phenylene polysulphide) type, the reflective parts being then metallised, for example with aluminium. This method of manufacture has the advantage of being inexpensive. The material may also be a thermosetting material. This would make it necessary to provide a radiator or cooling means for evacuating heat from the light source, especially where the latter is a photo-diode.

The material used may also be an injected metal of the aluminium type. This will eliminate the need to use a radiator, since the heat can be evacuated directly through the metal of the component itself.

In a second embodiment, the said component is press-formed.

According to the invention in a third aspect, a headlight for producing a regulation passing beam comprises a plurality of lighting modules according to the invention, the said modules being substantially identical to each other in structure and being arranged substantially parallel to each other.

Further features and advantages of the present invention will appear from the following description of an embodiment of the invention, which is given by way of illustration and is in no way limiting.

BRIEF DESCRIPTION OF THE DRAWINGS

In all of the Figures of the drawings, common elements carry the same reference numerals.

DESCRIPTION OF A PREFERRED EMBODIMENT OF THE INVENTION

Figure 1:
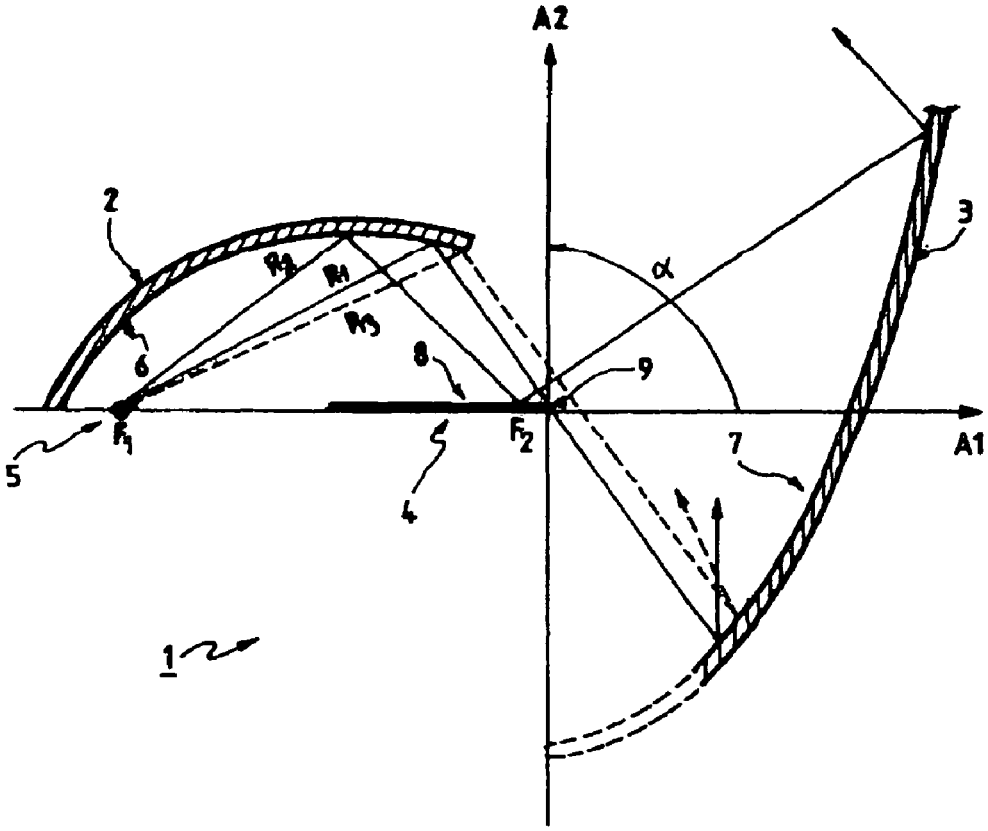
FIG. 1 shows diagrammatically a side view of a lighting module according to the invention, illustrating the path of the light rays.

The diagram of FIG. 1 is a side view of the lighting module 1, for a vehicle headlight according to the invention.

The module 1 comprises a first reflector 2, a second reflector 3, a third reflector 4 and a light source 5.

The first reflector 2 is an elliptical reflector having two foci F1 and F2, an optical axis A1, and a substantially elliptical reflective surface 6.

The substantially elliptical surface 6 is made in the form of an angular sector of what is substantially a body of revolution, extending into the half space which is situated above an axial plane at right angles to the plane of the drawing and containing the optical axis A1. In a first approximation, the surface 6 is a semi-ellipsoid.

However, it may be noted that the surface 6 may not be perfectly elliptical, and may have several specific profiles designed to optimise the light distribution within the light beam produced by the module 1. This implies that the first reflector 2 is not a perfect body of revolution.

Figure 4:
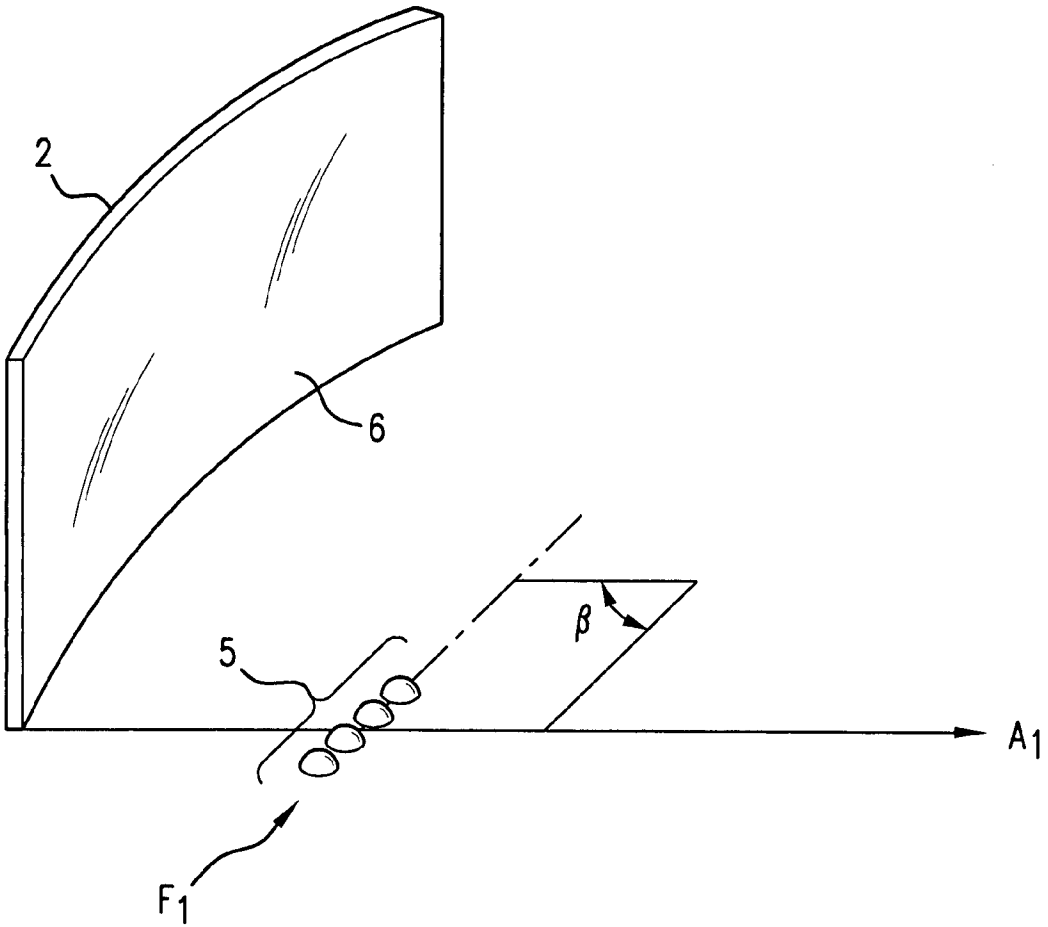
FIG. 4 shows a perspective partial view of the lighting module with a plurality of light sources according to the invention.

At least one light source 5 is arranged substantially at the first focus F1 of the first reflector 2, as shown in FIG. 1. Alternatively, the light source 5 may also comprise a plurality of light sources close to each other, which are generally aligned in a direction substantially at right angles, $\beta$ for example, to the optical axis A1 of the first reflector 2, as shown in FIG. 4. For illustration purposes, four light sources 5 are depicted in FIG. 4. It should be understood that the actual number of light sources may vary from two or more.

The light source 5 is preferably a light emitting diode which emits the greater part of its light energy towards the reflective internal surface of the substantially elliptical surface 6.

The second reflector 3 comprises a focus which is substantially coincident with the second focus F2 of the first reflector 2; an optical axis A2; and a reflective surface 7.

The optical axis A2 is substantially parallel to the longitudinal axis of a vehicle, not shown, which is equipped with the lighting module 1.

The optical axis A1 forms an angle $\alpha$ with the optical axis A2. The angle $\alpha$, as indicated in FIG. 1, is equal to 90°, but it may take other values as will be seen from the description below.

In a first embodiment of the invention, the reflective surface 7 is substantially parabolic in form, the axis of the parabola being the optical axis A2.

The third reflector 4 which may also be called the bender, is located between the first reflector 2 and second reflector 3, and has at least one reflective upper face 8 and a front terminal edge 9 which is called the cut-off edge.

The cut-off edge 9 is located in the vicinity of the second focus F2 of the first reflector 2.

It should be noted that the edge 9, as shown in FIG. 1, is straight, but the profile of the edge 9 may be modified in order to compensate for the field curvature of the substantially parabolic surface 7, as will be seen later herein.

The principle of operation of the lighting module 1 according to the invention is as follows.

In this connection, three light rays R1, R2 and R3, issued from the light source 5, will be considered for this purpose.

Since the light source 5 is arranged at the first focus F1 of the first reflector 2, the greater part of the rays emitted by the source 5, after having been reflected on the internal face 6, are transmitted towards the second focus F2 or towards the vicinity of the latter. This is the case for the ray R1 which passes along the cut-off edge 9, this ray R1 then being reflected on the surface 7 of the second reflector 3 in a direction which is substantially parallel to the optical axis A2 of the second reflector 3.

However, other rays may, after having been reflected on the internal face 6, be reflected on the surface 8 of the bender 4. This is the case for the ray R2. This ray R2 is then reflected once again on the parabolic surface 7, and this reflection is shifted towards the left in the plan view seen in FIG. 1. The ray R2 is then emitted below the cut-off line in the light beam. Without the reflection of the ray R2 on the surface 8, the ray R2 would be unacceptable (because it would be above the cut-off line).

Other rays, of the type typified by a ray R3, may pass above the cut-off edge 9. In that case, the ray R3 is also emitted below the cut-off line in the light beam.

One advantage of the lighting module 1 according to the invention is that it does not occult a major proportion of the light rays emitted from the source 5, as happens in a conventional lighting module which includes a mask.

The reflective surface 8 enables images of the light source 5, reflected by the elliptical surface 6 of the first reflector 2 towards the second focus F2, to be deflected or bent. The "bend" which is produced by this bending of images contributes to the formation of an overall cut-off line within the light beam reflected from the second reflector 3.

It should be noted that the angle $\alpha$ is chosen and optimised by using the property of the light emitting diodes to emit only into a half space, so that the first reflector 2 does not intercept part of the light flux reflected by the second reflector 3. The angle $\alpha$ which has been chosen for illustrating the invention is equal to 90°, but this angle may also be greater than 90° so as to give a more compact module while enabling the first reflector 2 not to intercept some of the light flux reflected from the second reflector 3.

In addition, it has been considered that the cut-off edge 9 is straight; this hypothesis implies that the field curvature of the parabolic surface 9 can be neglected.

In order to compensate precisely for significant aberrations in the parabola, with increasing distance from the optical axis A2, the straight edge shown in FIG. 1 can be replaced by an edge having a complex form.

Figure 2:
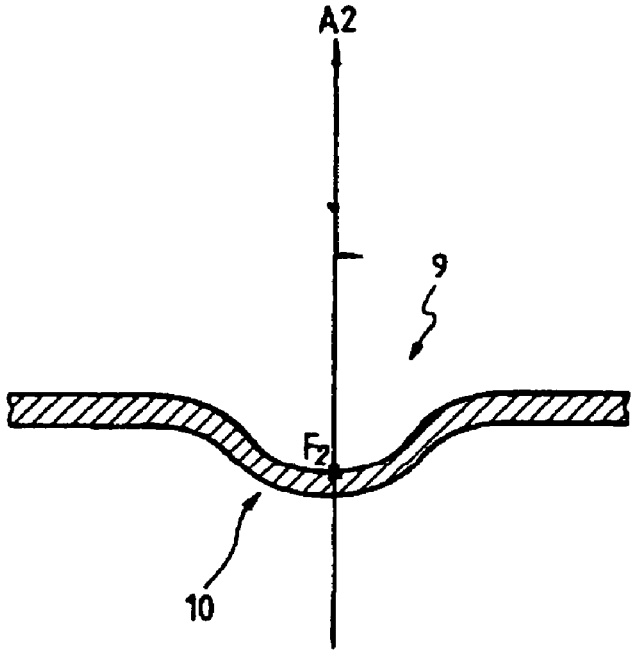
FIG. 2 represents the profile of a cut-off edge in a lighting module according to the invention.

In this connection, FIG. 2 shows the profile 10 of the cut-off edge 9 in the plane containing the optical axis A2 and at right angles to the plane in which FIG. 1 is drawn.

The profile 10 substantially follows the focal line of the second reflector, and this focal line corresponds to the intersection of the locus of the best foci of the second reflector with the plane which contains the optical axis A2 which is at right angles to the plane in which FIG. 1 is drawn. The latter is the plane defined by the optical axis A1 of the first reflector 2 and the optical axis of the light source 5.

A further solution consists in keeping a straight cut-off edge, and replacing the substantially parabolic surface of the second reflector with a surface of a complex type which is adapted to improve the cut-off and to control the distribution of light along the optical axis of the second reflector.

Figure 3:
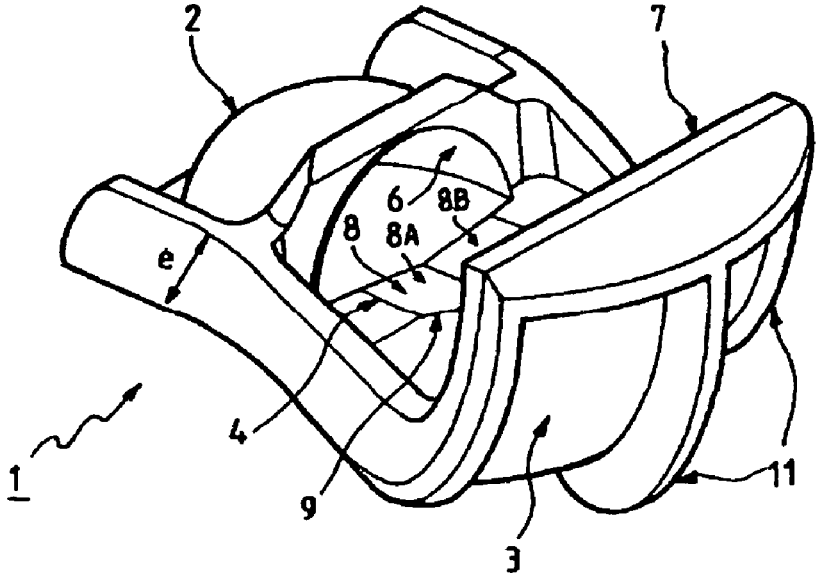
FIG. 3 shows a perspective view of a lighting module according to the invention.

FIG. 3 is a perspective view showing a lighting module according to the invention. This lighting module 1 is identical to the module 1 shown in FIG. 1, except that the angle $\alpha$ between the optical axis A2 of the second reflector 3 and the optical axis A1 of the first reflector 2 is equal to about 120°, so as to give a compact module while avoiding interception of a part of the light flux reflected by the second reflector by the first reflector 2.

The three reflectors 2, 3 and 4 here are all made as part of a single component 1.

The low thickness e of the member 1 enables all the reflectors to be injection moulded at once in a mould not having a pull-out piece with a thin member. This module 1 also has ribs 11. It should be noted that the reflective surface of the third reflector 4 includes two planes 8A and 8B which are inclined to each other to define a V, such that the cut-off edge 9 has a profile which approximately follows the focal line of the second reflector 3. This V-shaped profile is only an approximation of the theoretical focal locus, but other curved profiles may also be used.

In a first embodiment, the material used may be a standard thermoplastic material of the PPS (phenylene polysulphide) type, or a thermosetting material, the reflective parts being then metallised, for example with aluminium. Such a construction has the advantage that it is inexpensive. The first embodiment does however make it necessary to provide a radiating means to evacuate heat from the light source, especially when the latter is a photodiode.

In a second embodiment, the material employed may be an injected metal of the aluminium type. This version avoids the need for the cooling means, because the properties of the metal can be used to evacuate the heat.

Figure 5:
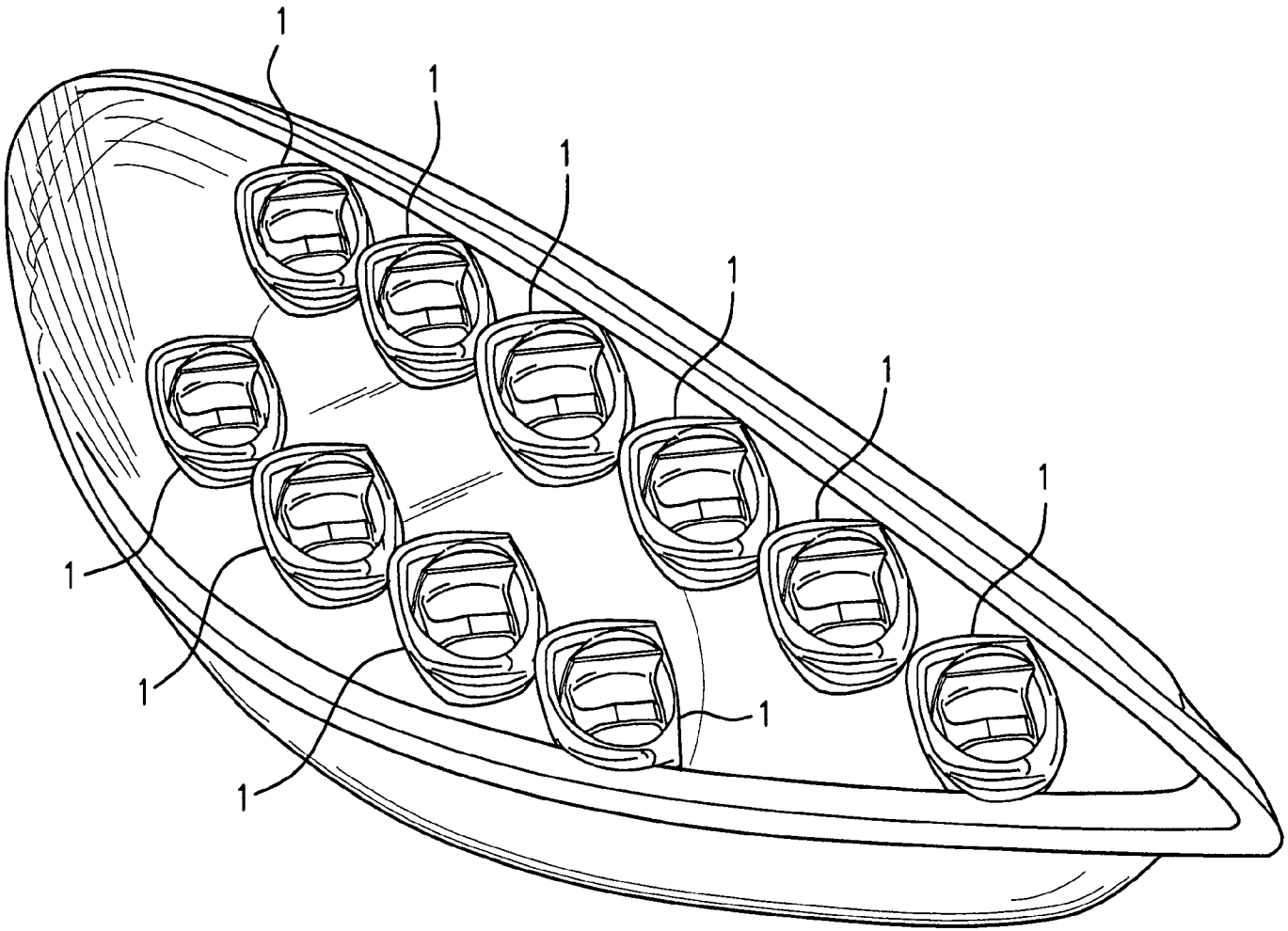
FIG. 5 shows a perspective view of the headlight including a plurality of lighting modules according to the invention.

A further embodiment is shown in FIG. 5, in which a headlight for producing a regulation passing beam includes a plurality of lighting modules 1. In this embodiment, the plurality of lighting modules 1 are substantially identical to each other in structure and arranged substantially parallel to each other.

The invention is of course not limited to the embodiments just described. Thus, the method of manufacture described above makes use of a moulding process, but press-forming could also be used.

Similarly, the module of the invention has been described as being made in one piece, but it is just as much possible to make the various reflectors separately.

Moreover, the light source described is a photodiode, but it could also be another type of light source such as the free end of a fibre optic. It is also possible to make use of any type of lamp located at the first focus of a light collector of an elliptical type, the exit for the light being situated at the level of the second focus of the collector.

What is claimed is:

1. A lighting module for a vehicle headlight for producing a light beam of the cut-off type, the module including:

a first reflector having a substantially elliptical surface for reflecting light rays, at least one light source arranged in the vicinity of the first focus of the said first reflector, a second reflector for producing the cut-off output beam, the focus of the said second reflector being located in the vicinity of the second focus of the said first reflector, and a third reflector that is a bender, the upper face of which is reflective, the said bender being located between the said first reflector and the said second reflector and having a cut-off edge, and which is arranged in the vicinity of the second focus of the said first reflector, whereby to form the cut-off in the light beam, the light source being a light emitting diode.

2. A module according to claim 1, wherein the said second reflector has a substantially parabolic surface for reflecting light rays.

3. A module according to claim 1, wherein the said second reflector is a reflector of the complex surface type for reflecting light rays.

4. A module according to claim 1, wherein the optical axis of the first reflector defines an angle with the optical axis of the said second reflector, whereby the said first reflector avoids intersection with light rays reflected by the said second reflector.

5. A module according to claim 1, wherein the said cut-off edge has a profile which is substantially identical to the focal line of the said second reflector in a plane which contains the optical axis of the said second reflector and which is at right angles to the plane defined by the optical axis of the said first reflector and the optical axis of the said light source.

6. A module according to claim 1, wherein the said cut-off edge is straight.

7. A module according to claim 1, wherein the substantially elliptical surface of the said first reflector is defined by an angular sector of a body which is substantially a body of revolution about the optical axis of the said first reflector, and wherein the said angular sector extends vertically above the reflective face of the said third reflector.

8. A module according to claim 1, including a plurality of light sources close to each other, which are generally aligned in a direction substantially at right angles to the optical axis of the first reflector.

9. A module according to claim 1, including means for displacing the said third reflector along the optical axis of the said second reflector.

10. A method of making a module according to claim 1, comprising the step of making the said first, second and third reflectors in one piece.

11. A method according to claim 10, wherein the said step comprises moulding the said piece in a material chosen from the group consisting of a thermoplastic material, a thermosetting material, and an injected metal.

12. A method according to claim 10, wherein the said step comprises press-forming the said piece.

13. A headlight for producing a regulation passing beam, the headlight including a plurality of lighting modules according to claim 1, the said modules being substantially identical to each other in structure and being arranged substantially parallel to each other.

* * * * *